United States Patent [19]

Schaaf et al.

[11] 4,207,718

[45] Jun. 17, 1980

[54] CONCRETE BLOCK WALL

[75] Inventors: Cecil Schaaf, Standish; Russell J. McIntosh; David C. Morton, both of Flushing, all of Mich.

[73] Assignee: Paul A. Kakuris, Chicago, Ill.

[21] Appl. No.: 18,717

[22] Filed: Mar. 8, 1979

Related U.S. Application Data

[63] Continuation of Ser. No. 906,106, May 15, 1978, abandoned.

[51] Int. Cl.[2] ..... E04C 1/08; E04C 1/10

[52] U.S. Cl. ..... 52/585; 52/293; 52/505; 52/586; 52/605; 405/20

[58] Field of Search ..... 52/228, 293, 436, 442, 52/505, 585, 586, 605; 405/20, 286

[56] References Cited

U.S. PATENT DOCUMENTS

| | | | |
|---|---|---|---|
| 346,734 | 8/1886 | Daniels | 52/505 |
| 497,959 | 5/1893 | Hesz | 52/585 X |
| 763,171 | 6/1904 | Fichefet | 405/20 |
| 815,641 | 3/1906 | Schoeneman | 52/607 |
| 1,959,816 | 5/1934 | Crum | 52/98 |
| 2,243,316 | 5/1941 | Larsen . | |
| 2,994,162 | 8/1962 | Frantz | 52/605 X |
| 3,222,830 | 12/1965 | Ivany | 52/100 |

FOREIGN PATENT DOCUMENTS

| | | | |
|---|---|---|---|
| 769330 | 6/1934 | France | 52/586 |
| 224910 | 3/1943 | Switzerland | 52/585 |

*Primary Examiner*—Alfred C. Perham
*Attorney, Agent, or Firm*—Hume, Clement, Brinks, Willian & Olds, Ltd.

[57] ABSTRACT

A wall comprising concrete blocks each having a longitudinally extending, wedge-shaped groove in one side thereof, the groove communicating with a pair of bores that extend through the block. The block is molded in a hollow shell or frame open at its top and bottom, the frame removably mounting a support from which depends a pair of cores by means of which the block bores are formed. Associated with the frame is a compactor and ejector member having at its lower end a base adapted to be accommodated snugly within the frame and having on its lower surface elongate, wedge-shaped grooving means that forms the groove in the block. The grooving means is longitudinally slotted to accommodate the core support and the grooving means and the base also are bored to accommodate the cores.

1 Claim, 6 Drawing Figures

CONCRETE BLOCK WALL

This is a continuation of application Ser. No. 906,106, filed May 15, 1978 now abandoned.

This invention relates to a molded concrete or the like construction block and to apparatus for its manufacture. The block is rectangular and has a V-or wedge-shaped groove in its upper surface. The block preferably is solid except for a pair of longitudinally spaced, vertically extending bores which communicate at their upper ends with the groove. The block is molded in accordance with conventional block molding techniques in a shell or frame within which is removably suspended a pair of cores carried by a support. Concrete is poured into the mold following which a compactor and ejector member is lowered into the mold. The compactor has at its lower surface a base beyond which extends a wedge-shaped grooving member which is vertically bored to accommodate the core members. The lowering of the compactor into the mold compacts the concrete and forms the groove, following which the compactor is pushed through the mold to eject the block from the mold.

Blocks constructed according to the invention are especially well suited for use in forming retaining walls, mat-like structures, and for other purposes. When blocks constructed according to the invention are arranged in vertical courses the bores of adjacent blocks may be so oriented as to accommodate vertical stabilizing rods which act to maintain the blocks in vertical alignment without the necessity of mortar. The grooves in horizontally adjacent blocks may accommodate horizontal stabilizing rods to maintain the blocks in longitudinal alignment without the use of mortar.

The construction of the blocks, the apparatus for their manufacture, and typical uses of the blocks are explained in the following description and are illustrated in the accompanying drawings in which.

Figure 1:
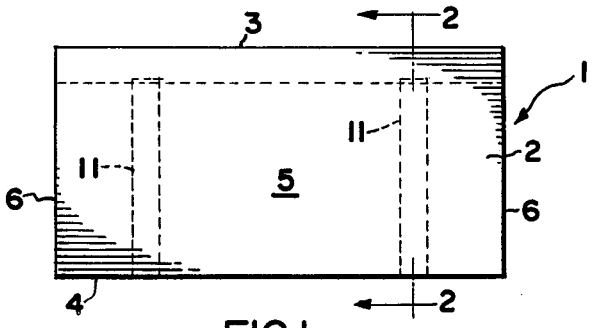
FIG. 1 is a side elevational view of a block constructed according to the invention.

A block formed in accordance with the invention is designated generally by the reference character 1 and comprises a preferably rectangular body 2 formed of concrete or similar moldable material and having a top 3, a bottom 4, opposed sides 5, and opposed ends 6. In the top 3 is a centrally located, longitudinally extending groove 7 having confronting sides 8 and 9 which extend along lines converging inwardly of the body and terminate in a flat base 10. The groove 7 extends the full length of the body. In communication with the groove 7 is a pair of longitudinally spaced bores 11 which extend vertically through the body 2 and normal to the groove. The diameter of the bore 11 is greater than the width of the base 10 for a purpose presently to be explained.

Figure 3:
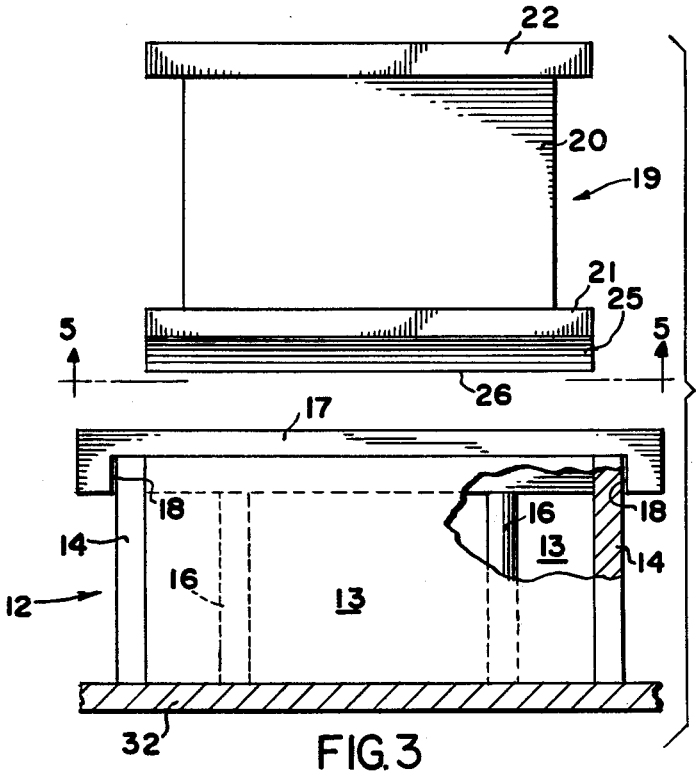
FIG. 3 is an exploded view, partly in section and partly broken away, of apparatus for molding the block shown in FIGS. 1 and 2.
Figure 4:
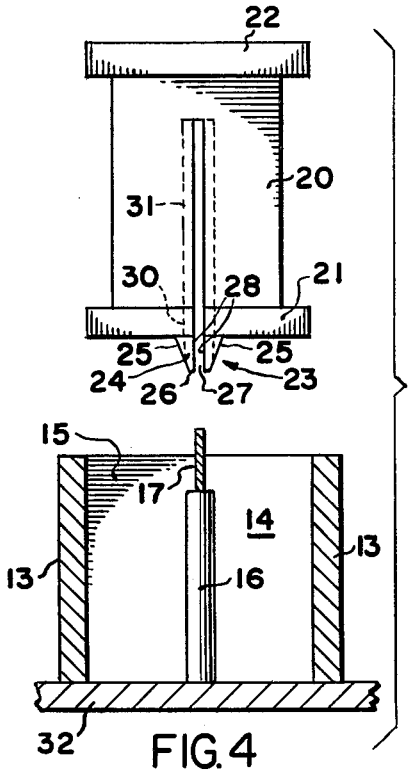
FIG. 4 is a side elevational view, partly in section, of the apparatus shown in FIG. 3.
Figure 5:
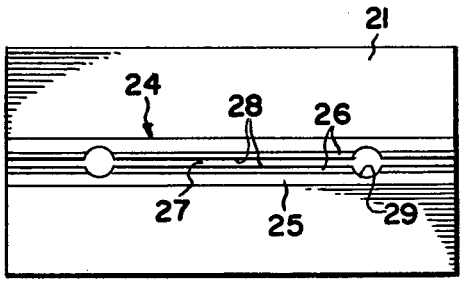
FIG. 5 is a bottom plan view of a portion of the apparatus shown in FIG. 3 as viewed in the direction of the arrows 5—5.

The block 1 may be produced by means of conventional concrete block molding machinery, although the mold structure with which such machinery normally is provided to form conventional concrete blocks is replaced by mold apparatus illustrated in FIGS. 3–5.

Mold apparatus for producing the block 1 comprises a frame 12 having opposed side walls 13 and opposed end walls 14 secured to one another to form a rectangular chamber 15 open at its top and bottom. Removably positioned within the cavity 15 is a pair of cylindrical cores 16 which are suspended from a supporting arm 17 which spans the cavity 15 and has notches 18 adjacent its opposite ends for reception of the associated end walls 14. The walls 14 may be notched, if desired, to facilitate centering of the arm 17. The cores 16 are of such length that their lower ends terminate in the plane of the bottom of the cavity 15, but the upper ends of the cores terminate at a level below that of the top of the cavity.

Also forming part of the mold apparatus is a compactorejector member 19 having a body 20 provided with a rectangular base 21 which is of such size as snugly, but slidably, to be accommodated within the cavity 15. At the upper end of the body is a plate 22 that is adapted for attachment to a reciprocable ram (not shown) forming part of the conventional block molding machinery.

Secured to and projecting downwardly from the base 21 is a grooving member 23 comprising an elongate, centrally-located, longitudinally extending projection 24 having external sides 25 which extend along lines which converge downwardly but terminate short of convergence to form a flat bottom 26. The grooving member is vertically slotted as at 27 over its full length to provide a pair of parallel, confronting sides 28 that are spaced from one another a distance sufficient to accommodate the support arm 17. The sides 28 are provided with semicircular recesses 29 for the accommodation of the cores 16. The base 21 is provided with a slot 30 and the sides of the body 20 are provided with similar slots 31, the slots 30 and 31 communicating with the slot 27. The combined height of the slots 30 and 31 preferably is greater than the length of the cores 16 by an amount sufficient to enable the member 19 to be pushed downwardly through the mold member 12 a distance sufficient to enable the lower surface of the base 21 to occupy the plane of the bottom of the mold member 12.

To condition the mold apparatus for the molding of a block 1, the mold member 12 is placed atop a pallet 32 which conventionally is supported by a vertically movable platen forming part of the block making machine. The support arm 17 is fitted to the mold member 12 with the cores 16 accommodated in the chamber 15. Concrete then is admitted to the chamber 15 so as substantially to fill the latter.

Following the filling of the chamber 15, the compactor-ejector member 19 is lowered into the chamber 15 and the mold member 12 is vibrated as the member 19 is being lowered so as to distribute the concrete uniformly throughout the chamber 15 and to compact the concrete. As the member 19 moves into the chamber of the mold 12, the grooving member 23 will form the wedge-shaped groove 7 and the cores 16 will form the bores 11. The member 19 is lowered into the mold member 12 a distance sufficient to ensure that the bores 11 will communicate with the groove 7.

Figure 2:
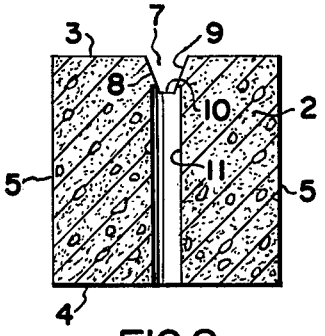
FIG. 2 is a vertical sectional view taken on the line 2—2 of FIG. 1.

Following molding of the block 1 in the mold member 12, the green block may be stripped from the mold in a conventional manner and cured. The cured block then will have the configuration illustrated in FIGS. 1 and 2.

Figure 6:
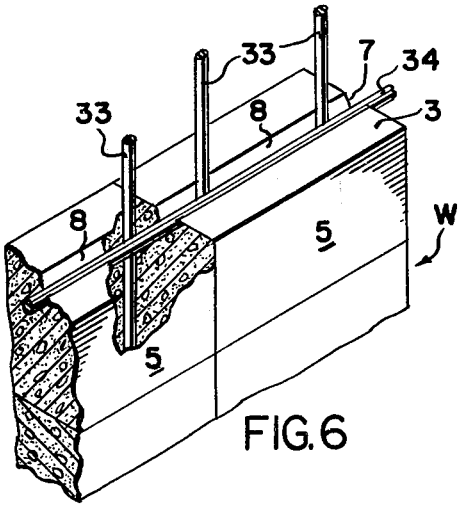
FIG. 6 is a fragmentary perspective view, partly in section, illustrating a typical wall constructed of blocks of the kind shown in FIGS. 1 and 2.

Blocks constructed in accordance with the invention may be used in many different ways, one of which is illustrated in FIG. 6 wherein a plurality of blocks 1 are arranged end-to-end in a substantially horizontal row and atop one another in vertical courses to form a vertical wall W. In the disclosed construction of the wall, the bores 11 of adjacent courses of blocks are aligned and are maintained in alignment by means of metal rods 33 which extend vertically through the aligned bores. The lower ends of the rods 33 may be embedded in the ground so as to maintain vertical alignment of the adjacent blocks. Horizontal alignment of the blocks may be maintained by a metal rod 34 which occupies the groove 7 of each adjacent block. The diameter of the rods 33 is less than the diameter of the bores 11 and the diameter of the rod 34 is less than the width and depth of the grooves 7 so as to enable the rods 34 to occupy the grooves 7 without extending above the upper surface 3 of the blocks. The downward convergence of the side walls of the grooves 7 assures engagement of the rod 34 between the rods 33 and the adjacent side wall of the groove, thereby maintaining the blocks in horizontal alignment.

A particularly advantageous use of a wall constructed in a manner disclosed in FIG. 6 is the construction of docks or other members which are totally or partially under water. In the event the water freezes, the individual blocks are capable of shifting relative to each other during the expansion and contraction of ice.

This disclosure is representative of a presently preferred form of the invention but is intended to be illustrative rather than definitive thereof. The invention is defined in the claims.

We claim:

1. An assembly of building blocks comprising:

a plurality of blocks, each block including a rectangular body having substantially parallel top and bottom faces, substantially parallel front and back faces, and substantially parallel right and left end faces;

each of said faces being substantially planar;

each top face including a groove disposed along a longitudinal axis of the top face, each groove having a pair of converging side surfaces extending along the longitudinal axis;

each block having a pair of spaced bores intersecting the groove of the block and extending between the top and bottom faces substantially parallel to the front, back, and end faces of the block;

adjacent blocks arranged in courses such that adjacent end faces are placed in mortarless abutment and adjacent grooves are substantially aligned;

adjacent courses arranged in mortarless abutment such that at least a portion of the bores in adjacent courses are aligned;

a first plurality of reinforcing rods disposed in said grooves to maintain said blocks in substantial alignment;

a second plurality of reinforcing rods disposed in said bores to maintain said blocks in substantial alignment and to maintain each of said first plurality of rods in place against one of the converging side surfaces of each groove, said first and second pluralities of rods dimensioned smaller than the grooves and bores, respectively, to permit relative movement between adjacent blocks.

* * * * *